United States Patent [19]

Ulanet

[11] 4,266,211

[45] May 5, 1981

[54] SNAP ACTION THERMOSTATS

[76] Inventor: Herman Ulanet, c/o George Ulanet Company, 413 Market St., Newark, N.J. 07105

[21] Appl. No.: 899,357

[22] Filed: Apr. 24, 1978

[51] Int. Cl.[3] ..... H01H 9/00; H01H 37/00

[52] U.S. Cl. ..... 335/208

[58] Field of Search ..... 335/146, 208

[56] References Cited

U.S. PATENT DOCUMENTS 3,206,573 9/1965 Anderson et al. ..... 335/146 X

FOREIGN PATENT DOCUMENTS 1185699 1/1965 Fed. Rep. of Germany ..... 335/146

1216410 5/1966 Fed. Rep. of Germany ..... 335/208

*Primary Examiner*—Fred L. Braun

[57] ABSTRACT

A thermostatic switch having a magnetic armature made of a Curie point alloy which changes its magnetic permeability as a function of an increase or decrease in the temperature. The thermoswitch may be normally open or normally closed so that the switch will close or open with a change in temperature.

13 Claims, 7 Drawing Figures

SNAP ACTION THERMOSTATS

Figure 1A:
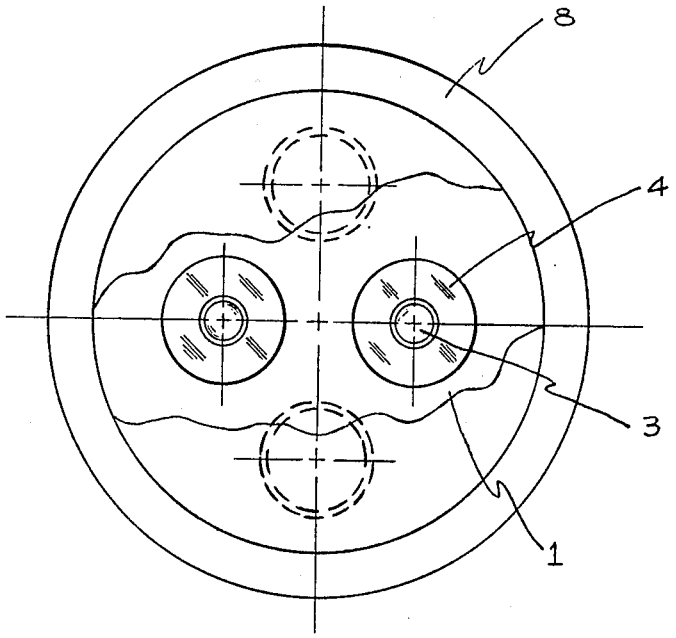

The object of my subject invention is to provide a snap action thermostat with advantageous characteristics of greater thermal fidelity and repeatability and longer useful life of its contacts. Also it can be calibrated more accurately and consistently at lower manufacturing costs then those that are in common use heretofore.

Rather than a thermostatic bimetal, the thermosensitive element in my invention is an armature made of Curie point metal alloy which becomes non-magnetic at given specified temperatures.

The interaction between said armature and cooperating permanent magnet mechanically opens and closes a set of contacts in my thermostat at the instant the Curie point armature reaches or drops below the critical temperature at which the armature becomes non-magnetic or magnetic.

The prevailing structure of miniature thermostats employs a thermosensitive bimetal for opening and closing electrical circuit at a preset temperature. The bimetal element generally is of two configurations. One design is a cantilever shaped bimetal that effects a low temperature differential between the make and break of the circuit. However, this design has the disadvantage in applications that are subject to vibration. False makes and breaks of the contacts due to vibration causes contacts to chatter and consequent short contact life. Furthermore, if the thermostat is incorporated in radio communication equipment, the contact chatter of a slow make-slow break thermostat imposes objectionable radio circuit distortion.

To obviate the objections of cantilever design of slow make-slow break bimetal element thermostats, snap action bimetal thermostats in which the contacts inherently open and close with a quick break and quick make, are preferred in applications in which broad temperature differentials are tolerable. The most widely used design of a snap action thermostat comprises essentially a stationary contact in cooperation with a movable contact affixed directly to the center of a circular disc of thermo-sensitive bimetal, which by mechanical means has been previously formed to slight convex curvature. As soon as the critical temperature of the convex bimetal disc is reached due to exposure to heating, it snaps, causing its convexity to transfer to the obverse face of the disc. The mating contacts of the thermostat assembly either open or close an electrical circuit depending upon the intended functional design.

In some designs the movable contact is affixed to an auxiliary spring member, which in turn is mechanically operated by the "on" and "off" snapping of a plain bimetal snap action thermostatic round disc.

Aside from the inherent broad temperature differential of the thermostatic disc snap action thermostat there are other disadvantages. Molecular crystallization of the bimetal flexing causes temperature drift from its original calibration. Also, the non-uniform thickness of the cross-section of the bi-metal strips from which the discs are blanked and formed is another cause of non-uniform thermal performance of the discs.

Thus, in mass production the bimetal discs must go through the costly operation of selective temperature calibration sorting in a number of oil baths that are controlled at given temperatures.

Besides the variations in temperature response of the fabricated bimetal discs, there are additional variations in temperature response incurred during the final assembly of the bimetal snap action thermostats.

In the final calibration inspection of the so called "snap action" thermostats, many behave like slow break-slow make thermostats. That is, the mechanical snap action takes place after the actual slow opening of the contacts rather than at the very instant of the contact opening.

I have invented a snap action thermostat that has a low temperature differential between the make and break of the contacts in contrast with the snap action thermostats previously described. Besides the low temperature differential of the subject invention, the opening and closing of its contacts take place consistently in synchronism with the snap action of the magnetic armature.

Whereas in the bimetal disc snap thermostat on the market the bimetal disc snaps oftimes after the slow opening of the contacts. It is understandable when this condition occurs the current rupturing advantage of a snap action thermostat is lost especially in an inductive circuit.

Another contrast between the snap action thermostat on the market and that of the subject invention is that in the former a convex bimetal disc is punched out of bimetal strip having metalurgical variations; the mechanical convex forming of the disc also adds to the functional inconsistency of the convex bimetal disc. Whereas in the subject invention the thermosensitive element is blanked out flat from a strip of Curie point alloy metal and is free from molecular strains and distortions. Because the thermosensitive element in subject thermostat is structurally stable the performance repeatability of said thermostat is consistent.

Figure 1:
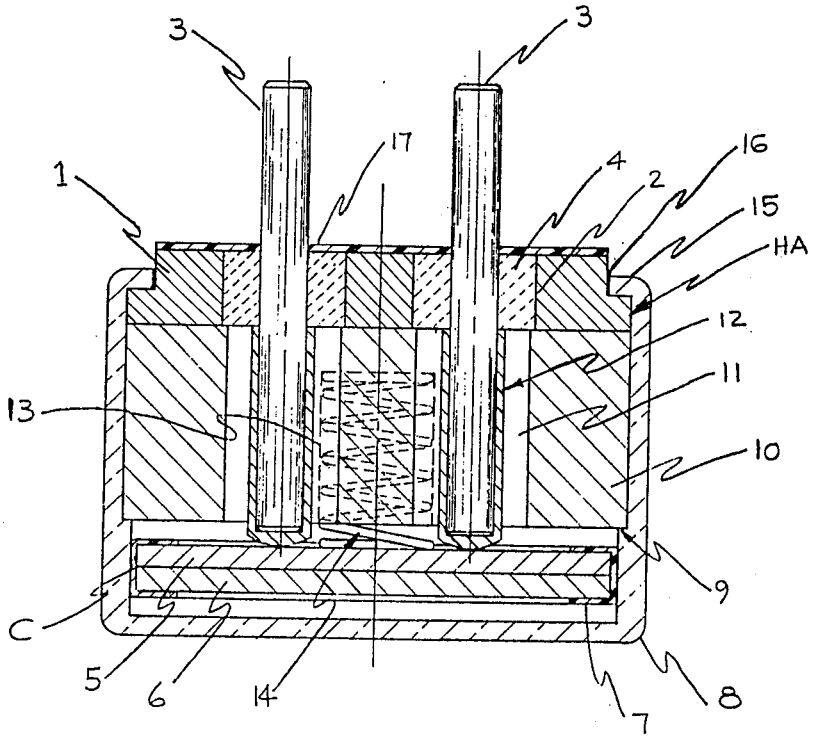

Comprehension of my invention will be aided by the description of design details in the following six drawings:

FIG. 1. Illustrates a cross-sectional view of the subject thermostat invention with the contacts shown in the closed position; that is, before disc "C" armature made of Curie point metal reached the critical temperature at which it would become non-magnetic.

FIG. 1-A. Is a plan view of subject invention.

Figure 2A:
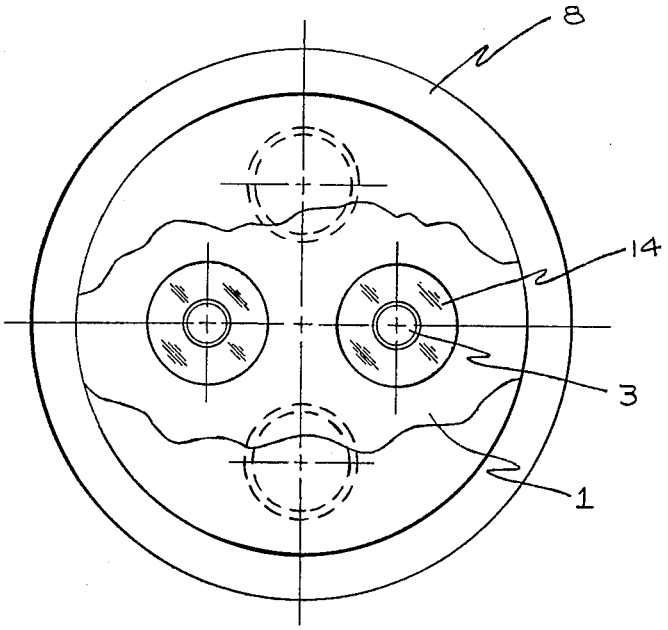
Figure 2:
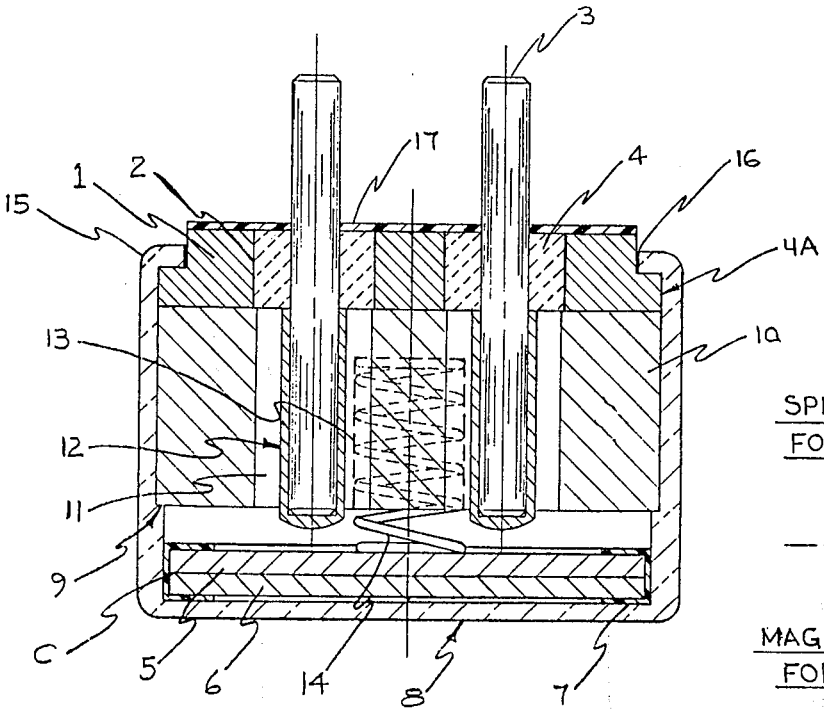

FIG. 2. Is a cross-sectional view of said thermostat showing contacts in the open position; that is, after disc, "C" armature made of Curie point metal reached the critical temperature at which it became non-magnetic.

FIG. 2-A. Is a plan view of subject invention.

Figure 3:
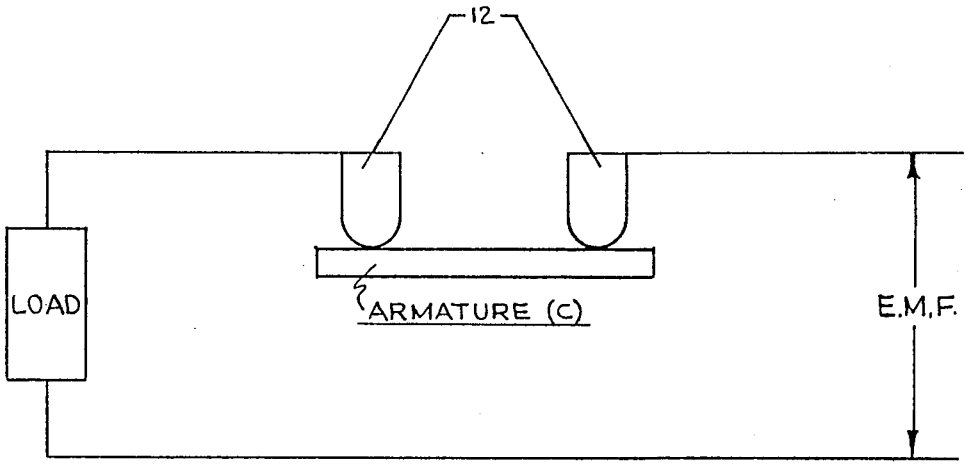

FIG. 3. Is a schematic circuit diagram showing contacts of said thermostat in the closed position.

Figure 4:
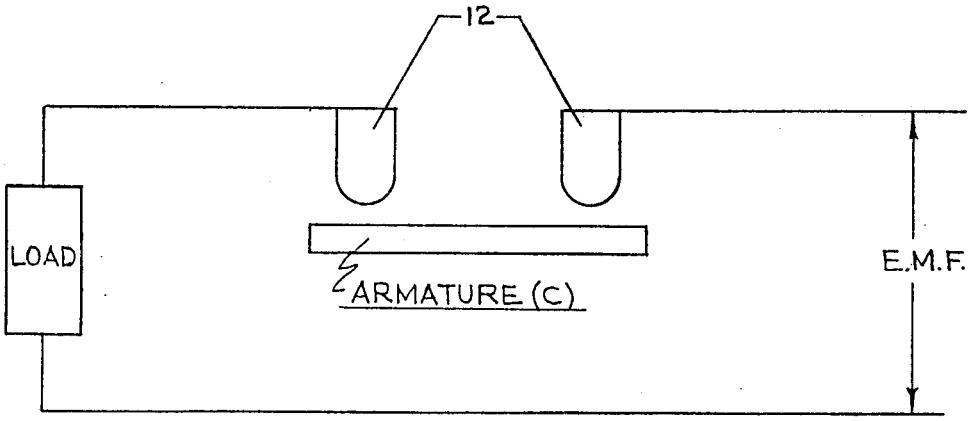

FIG. 4. Is a schematic circuit diagram showing contacts of said thermostat in the open positon.

Figure 5:
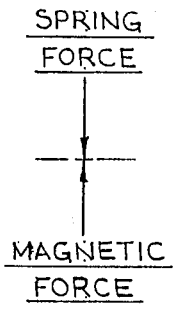

FIG. 5. Is a vector diagram illustrating the magnetic force of the magnet in the thermostat opposing force of compression spring in said thermostat.

FIGS. 2 and 4. Illustrates the single pole double break switching arrangement of the subject thermostat by virtue of the fact the armature "C", being an electrically conductive bridge between both contacts, 12.

A single pole double break switch, it is well known, has longer contact life than a single pole single break switch for a given electrical current.

The open position of the contacts shown in FIGS. 2 and 4 resulted from armature disc, "C" made of Curie point metal, reaching the critical temperature that rendered the disc, "C" non-magnetic. Subsequently, the opposing force of the compression spring, 14 overcame the magnetic attraction on disc "C".

Referring to FIG. 1, HA is a header assembly comprised of metal or steel base, 1 provided with two holes, 2 into which terminals, 3 are hermetically sealed in perpendicular relation to base, 1 by means of suitable molten glass beads, 4. For thermostat applications not requiring hermetic sealed enclosure less expensive means, well known in the industry, for electrically insulating terminals 3 from metal base 1 shown in FIGS. 1 and 2 can be utilized.

"C" is a composite metal disc comprising an upper layer of fine silver or any other suitable electrical contact material, 5 secured to a lower layer of Curie point metal alloy that decreases in magnetic permeability with temperature increase, 6 selected for a specific Curie point temperature. That is, the lower layer of the disc, "C" becomes non-magnetic at the specific selected temperature.

Therefore, by employing a Curie point metal disc armature as the temperature sensor in combination with a magnet, the costly calibration process of the previously described bimetal thermostat is obviated.

Further description of components of subject invention is hereby continued.

7 is suitable insulating material to electrically insulate disc "C" from cup shaped metal or steel housing, 8 of the thermostat which is provided with shoulder, 9. Upon shoulder, 9 is supported metallic magnet, 10 or made preferably of electrically non conductive material. In magnet, 10 are provided clearance holes, 11 through which terminals, 3 pass. Cavity, 13 in magnet, 10 is provided to accommodate compression spring, 14. The inner ends of terminals, 3 are provided with suitable electrical contact material, 12.

After disc, "C" and steel compression spring, 14 and magnet, 10 are assembled into housing, 8 the upper edge of housing, 8 is curled over shoulder of header HA as indicated at 15. A bead of suitable solder, 16 joins header HA to housing, 8 and thus completes the hermetic sealing of my thermostat invention.

WORKING PRINCIPLE

I hereby describe the working principle of my subject snap action thermostat invention by referring to FIG. 1.

Lower portion, 6 of armature, C is made of Curie point metal alloy which becomes non-magnetic when it reaches its Curie point temperature. Magnet, 10 then can no longer exert a magnetic pull on armature C. Subsequently, the opposing force of compression spring 14, (see FIG. 5) overcomes the magnetic pull of magnet, 10 and thus contacts 12, separate from silver clad, 5 attached to lower portion, 6 of armature, C.

When temperature of lower portion, 6 of armature, C drops below the Curie point temperature it regains its magnetic permeability. Magnet, 10 then exerts a magnetic force upon armature, C which overcomes the opposing force of compression spring, 14 as indicated in FIG. 5 resulting in the reclosing of contacts, 12 and silver clad, 5 attached to lower portion, 6 of armature, C.

The working principle of thermostats shown in FIGS. 1 and 2 was described of a normally closed thermostat which opens contacts on temperature rise and recloses on temperature drop. In this thermostat the lower layer of armature C is made of a Curie metal that has a characteristic that decreases its magnetic permeability as the temperature rises and increases its magnetic permeability with drop in temperature.

If lower layer 6 of armature "C" was made of available Curie metal which had opposite magnetic characteristic from that of the previously described Curie metal the armature would increase its magnetic permeability with temperature rise and decrease its magnetic permeability with temperature drop.

By substitution of a Curie metal that increases its magnetic permeability with temperature rise for the lower layer of armature "C" it would convert the firstly described thermostat from a normally closed thermostat to normally open thermostat that closes contacts with temperature rise and re-opens contacts on temperature drop without altering the design and configuration of the other components of the thermostats described in FIGS. 1 and 2.

It is obvious therefore that inventory of parts required for manufacturing both normally closed and normally open thermostats would be reduced in half at great moneysaving to the manufacturer of the disclosed thermostats and would simplify and expedite production.

The common accepted definition in industry of a normally open thermostat is that it closes contacts with temperature rise and reopens contacts on temperature drop.

In summary my subject thermostat invention has many advantages over the snap action thermostats on the market which I previously described.

Firstly, the magnetic armature made of Curie point alloy is the thermosensitive element in my thermostat. There are no molecular strains incurred in its fabrication. The temperature at which the armature activates opening and closing of the contacts is finite because it is determined by the metallurgical compounding of the Curie point metal.

Whereas the convex bimetal disc is the thermosensitive element in the previously described bimetal snap action thermostats now on the market. As explained, the non-uniform metallurgical charactistics of the bimetal strips from which the bimetal discs are blanked is one of the factors that causes non-uniform thermostatic performance of the discs. Another factor that contributes to non-uniform thermostatic functioning of the bimetal discs is the molecular strains incurred in the convex forming of the discs.

Secondly, my snap action thermostat inherently has a lower temperature differential than the ones using the bimetal convex disc because the latter posses inherent thermal inertia.

Thirdly the subject invention has a single pole double break switching arrangement that increases the current rupturing capacity over the single pole single break switching that is in bimetal disc snap action thermostats.

I claim as follows:

1. A snap action thermostatic switch comprising a permanent magnet fixedly positioned in a housing, contacts affixed to lower ends of a pair of straight rigid terminals insulated from each other, the upper ends of said terminals affixed perpendicularly through a header and electrically insulated therefrom, said lower ends of said terminals passing through clearance holes in said permanent magnet and electrically insulated therefrom, said terminals being in operative registry with a bridging contact attached to a facing side of a low mass Curie point moveable magnetic disc armature so that a temperature change in said disc of a given Curie alloy characteristic correspondingly changes its magnetic permeability to such extent that the pull of said permanent magnet overcomes the counteracting force of a compression spring located centrally in a cavity of the lower end of the permanent magnet thereby causing single pole double break contacts either to close or open an electric circuit.

2. A snap action thermostatic switch as described in claim 1 housed in a metal enclosure.

3. A snap action thermostatic switch as described in claim 1 housed in a hermetically sealed steel enclosure.

4. A snap action thermostatic switch as described in claim 1 except wherein contacts are enveloped in a magnetic field comprising the permanent magnet, housing, header, terminals and compression spring; magnetic flux of said magnetic field, snuffs out arcing of said contacts at the instant of opening or closing an electric circuit thus prolonging the useful life of said contacts.

5. A snap action, thermostatic switch as described in claim 1 that requires no structural re-arrangement of its parts, other than substituting the appropriate metalurgical alloy for the Curie point magnetic armature, to render the contact arrangement of said switch either normally closed to open with temperature rise or normally open to close contacts with temperature rise.

6. A snap action thermostatic switch as described in claim 1 that requires no heat and cooling cycling for temperature calibration as the mix of the Curie point alloy from which magnetic armature is made fixes the temperature at which thermostatic switch contacts will either open or close.

7. A snap action thermostatic switch as described in claim 1 whereby the opening or closing of the contacts take place synchronously with the magnetic attraction of the magnetic armature by the permanent magnet or by the opposing force of the counteracting compression spring.

8. A snap action thermostatic switch as described in claim 1 except that the permanent magnet is non-conductive.

9. A snap action thermostatic switch as described in claim 1 wherein the compression spring that counteracts the pull of the permanent magnet is located within an axial cavity of said permanent magnet.

10. A snap action thermostatic switch as described in claim 1 in which said moveable magnetic armature is made of a Curie point alloy that decreases its magnetic permeability with temperature rise thus effecting a thermostat with normally closed contacts which open with temperature rise and reclose with temperature drop.

11. A snap action thermostatic switch as described in claim 1 in which said moveable magnetic armature is made of a Curie point alloy that increases its magnetic permeability with temperature rise thus effecting a thermostat with normally open contacts which close with temperature rise and reopen with temperature drop.

12. A thermostatic switch as described in claim 1 in which the metal housing serves as the fastener that holds the components of said thermostatic switch in completed assembly.

13. A thermostatic switch as described in claim 1 whereby the opening or closing of the contacts take place synchronously with the magnet attraction of the magnetic armature by the permanent magnet or by the opposing force of the compression spring.

* * * * *